US005589226A

United States Patent [19]

Geul

[11] Patent Number: 5,589,226

[45] Date of Patent: Dec. 31, 1996

[54] METHOD AND DEVICE FOR APPLYING LIQUID MATERIAL, IN PARTICULAR A HOT MELT, BY MEANS OF A SEQUENTIALLY OPERATING APPLICATOR TO A SUBSTRATE

[75] Inventor: Herman R. Geul, Leiden, Netherlands

[73] Assignee: Nordson Corporation, Westlake, Ohio

[21] Appl. No.: 347,328

[22] PCT Filed: Jun. 2, 1993

[86] PCT No.: PCT/NL93/00113

§ 371 Date: Nov. 30, 1994

§ 102(e) Date: Nov. 30, 1994

[87] PCT Pub. No.: WO93/24239

PCT Pub. Date: Dec. 9, 1993

[30] Foreign Application Priority Data

Jun. 4, 1992 [NL] Netherlands ..... 9200984

[51] Int. Cl.[6] ..... B05D 5/00; B05C 5/00

[52] U.S. Cl. ..... 427/286; 427/256; 427/288; 118/679; 118/672; 118/698; 118/324; 118/411

[58] Field of Search ..... 427/288, 256, 427/286; 118/411, 679, 672, 698, 324

[56] References Cited

U.S. PATENT DOCUMENTS 4,225,638 9/1980 Waush ..... 18/411

4,687,137 8/1987 Boger et al. ..... 118/411

*Primary Examiner*—Katherine Bareford

*Attorney, Agent, or Firm*—Paul E. Milliken, Esq.

[57] ABSTRACT

The invention relates to a method and device for applying a material pattern by means of a sequentially operating applicator to a substrate moving relative to said applicator, by way of a control valve for liquid material, in particular a hot melt, said valve being controllable for opening and closing, which material pattern in the direction of movement is sub-divided into pattern parts with slight spacing between them, and there being at least two control valves connected to the material supply, and the respective valves being made to open and close sequentially. A considerably faster operation is achieved this way.

13 Claims, 5 Drawing Sheets

METHOD AND DEVICE FOR APPLYING LIQUID MATERIAL, IN PARTICULAR A HOT MELT, BY MEANS OF A SEQUENTIALLY OPERATING APPLICATOR TO A SUBSTRATE

FIELD OF THE INVENTION

The invention relates to a method for applying a material pattern by means of an applicator to a substrate moving relative to said applicator, by way of a control valve for liquid material, in particular a hot melt, said valve being controllable for opening and closing and being connected to a material supply, which material pattern in the direction of movement is sub-divided into pattern parts with slight spacing between them, and to a device for carrying out said method.

BACKGROUND OF THE INVENTION

Applying a liquid material, in particular a hot melt, by means of an applicator to a substrate by way of a control valve with controllable opening and closing is a technique which is known per se.

So long as the speed of the material relative to the applicator remains below certain values and the space between the pattern parts is not too small, no particular problems occur, despite the fact that, particularly in the case of pneumatically operated valves, for obtaining a well-defined pattern, i.e. not ragged, large-size air supply and discharge ducts are needed in order to be able to supply and evacuate the control air in a short time.

However, the situation changes when the relative speed increases and the space between the pattern parts has to be small. In this case the time which elapses between quickly making the valve close and subsequently quickly making the valve open is too short to obtain a good effect. This problem occurs in particular in the case of pneumatically controlled valves, in the case of which considerable quantities of air have to be supplied or discharged through large-size ducts in order to obtain the desired rapid opening and closing of the valves.

The object of the invention is to provide a solution to this problem. According to the invention, for this purpose use is made of at least two control valves which are connected to the material supply and are made to open and close sequentially.

If, for example, there are two control valves and the first of these two is made to close at the end of its working cycle through rapid evacuation of the control air, and is not in a position to allow material through again very shortly afterwards by being made to open, the function of said first valve is taken over by the second valve, which is made to open at the correct moment; during the open period of this second valve, there is an opportunity for the situation in the first valve to recover, and said first valve is ready for the next working cycle the moment the second valve is made to close. A very rapid and error-free operation is achieved in this way.

Of course, the principle according to the invention can also be applied to a system with more than two control valves—for example three or even four—which are controlled sequentially.

It is also possible to divide these valves into two or more sets, each set comprising at least two valves, and said sets being made to open and close sequentially. For example, it is possible to make an applicator interact with four or six control valves, sub-divided into two or three sets of two or three valves each, so that even in the case of an applicator with a relatively long nozzle a good effect remains guaranteed.

It is pointed out that an applicator with two control valves is known per se from U.S. Pat. No. 4,735,169. In the case of this known device, however, these control valves are made to open and close simultaneously, so that the principle on which the invention is based is not known from this publication.

BRIEF DESCRIPTION OF THE DRAWINGS

The invention is explained with reference to the drawings in which:

FIGS. 1*a*, 1*b* and 1*c* give examples of patterns of a liquid material, in particular a hot melt, to be applied to a substrate;

DESCRIPTION OF THE PREFERRED EMBODIMENT

Figure 7C:
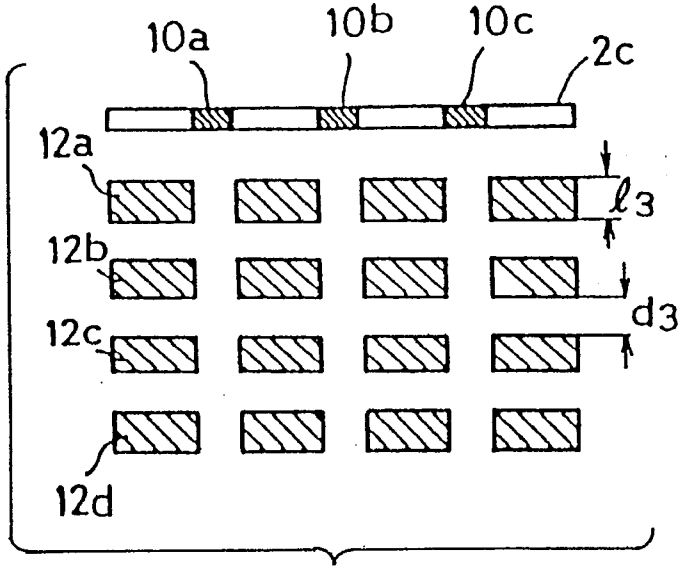
Figure 7B:
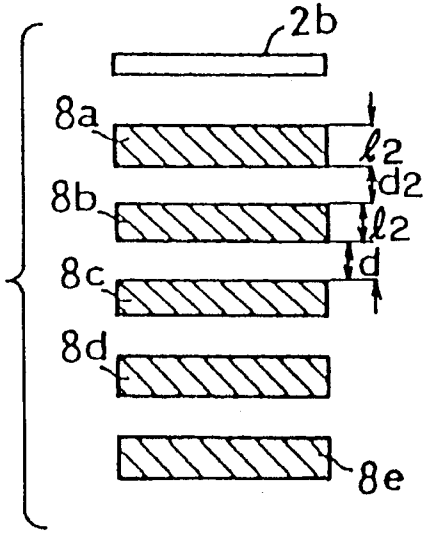
Figure 7A:
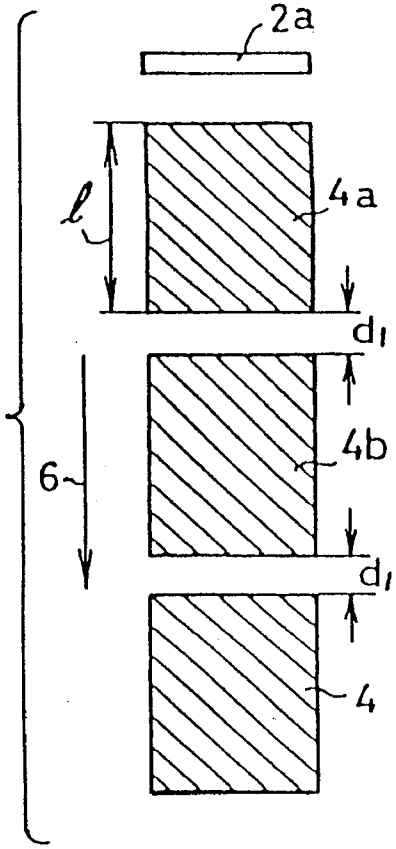

In FIG. 1*a* reference number 2*a* indicates the outflow nozzle of an applicator, which is known per se and is not shown in any further detail, for applying strips of liquid material, in particular a hot melt adhesive, in a fixed pattern to a substrate, which is considered to be the plane of the drawing, three of which strips are shown and are indicated by reference numbers 4*a*–4*c*. The substrate must move in the direction of the arrow 6 below the outflow nozzle 2*a* at a speed of, for example, 100 m per minute, thus 1,670 mm/sec, while the distance d between the respective material strips can be 3 mm. This means in fact that the time elapsing between the shutting off of the material supply to the applicator opening 2 and the reopening of said supply must be no longer than 1.8 ms. The length $l_1$ is approximately 30 mm, corresponding to an application time of approx. 20 milliseconds.

FIG. 1*b* relates to the situation in which narrow strips of material, indicated by 8*a*–8*e*, must be applied by means of the nozzle 2*b* to the substrate. The distance $l_2$ between the longitudinal edges of each material strip is in this case equal to the space d2 between the respective material strips. Here again, therefore, a period of only 1.8 ms is available for both the supply period of the material and the period in which the material supply is interrupted.

Finally, FIG. 1*c* shows by way of example how a regular pattern of rows of material points 12*a* . . . 12*d*, each with a length $l_3$ and a space d3 between them of approx. 3 mm can be applied to a substrate with a single applicator nozzle 2*c*, provided with a number of obstructions 10*a*–10*c*. Here again, only 1.8 ms is available as the time in which the material supply takes place or is interrupted.

This cannot be achieved with the device according to the prior art, but it can with the measures according to the invention. The principle of the invention is explained with reference to FIGS. 2 and 3.

Figure 2:
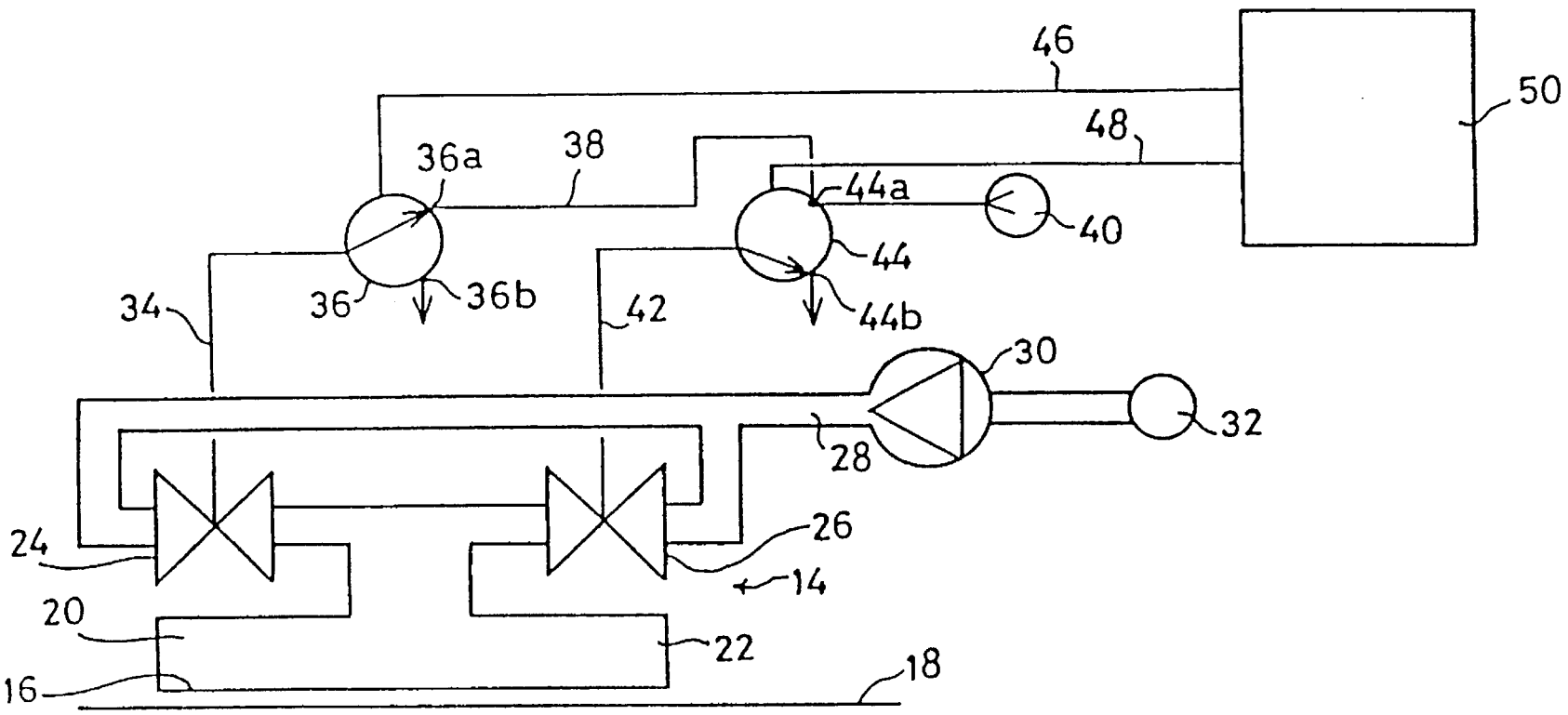
FIG. 2 shows diagrammatically a plant with which the method according to the invention can be used.

FIG. 2 shows diagrammatically an applicator 14, the nozzle 16 of which lies a short distance above the substrate 18 moving relative thereto and at right angles to the plane of the drawing. The space 20 inside the applicator nozzle 22 is connected by means of two pneumatically controlled control valves 24, 26 to the common material supply line 28, through which the material, in particular a hot melt, is supplied under the influence of the pressure pump 30, under pressure from a source 32. The control valve 24 is pneumatically controlled by means of the line 34 by the shuttle valve 36, the connection 36*a* of which is in communication by means of the line 38 with a pressure medium source 40, and the connection 36*b* of which opens out into the atmosphere, or can be connected to an air vent. The control valve 26 is controlled by means of the line 42 by the shuttle valve 44, the connection 44*a* of which is in communication with the line 38, and thus with the pressure medium source 40, while the connection 44*b* opens out into the atmosphere.

The shuttle valve 36 and the shuttle valve 44 are controlled electrically by means of control lines (46, 48 respectively) by a central control unit 50, which supplies the shuttle valves 36 and 44 with the current pulses which are necessary for the control thereof.

Figure 3:
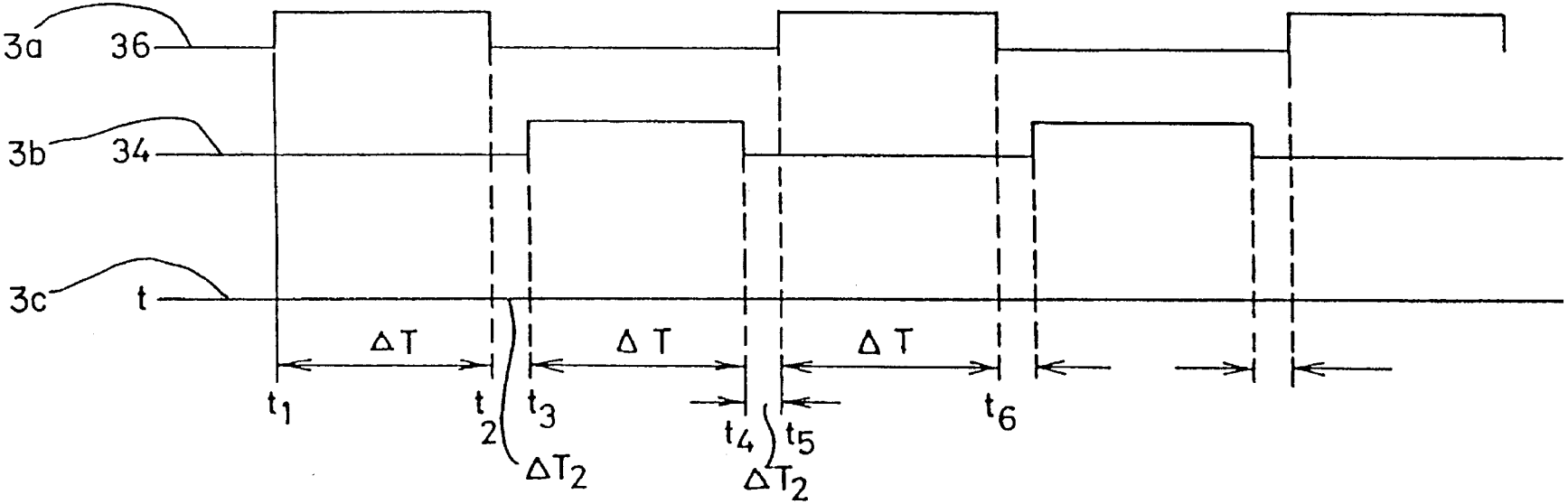
FIG. 3 shows a time chart of the opening and closing times of the valves used in the plant according to FIG. 2.

The course of said control pulses as a function of time is indicated in FIG. 3, in which figure the line 3*a* relates to the current pulses supplied to the shuttle valve 36, the line 3*b* relates to the current pulses supplied to the shuttle valve 44, and the line 3*c* is the time axis. It is assumed that during the current pulses applied to the shuttle valves 36 or 44 the latter are controlled in such a way that the control valve 24 or 26 controlled thereby is open. The chart relates to the situation shown diagrammatically in FIG. 1*a*.

The control valve 24 thus opens at the moment t1 and closes at the moment t2; the time interval ΔT1 corresponds to the length $l_1$ of the material strip 4*a* in FIG. 1*a*. During this period of time, which can be, for example, 20 ms, the material flows out of the nozzle aperture 2*a*.

At the moment t3, ΔT2 after t2, for example 1.8 ms after t2, the control valve 26 is opened. This situation continues until the moment t4, ΔT1 after t3, and during this period the material is now supplied by means of the control valve 26 to the outflow aperture 16 of the nozzle 22, resulting in the material strip 4*b*. The function of the material supply is then taken over again by the control valve 24, which opens at the moment t5 and remains open until the moment t6. The control valve 26 then takes over the function of the control valve 24.

It is clear that with such a method of operation of the applicator nozzle the two pneumatically operated control valves 24 and 26 after closure have plenty of time to move into a stable closed position in which transitional phenomena have died out, and the valves are in a position in which they can be opened reliably again in order to ensure the material supply.

Figure 4:
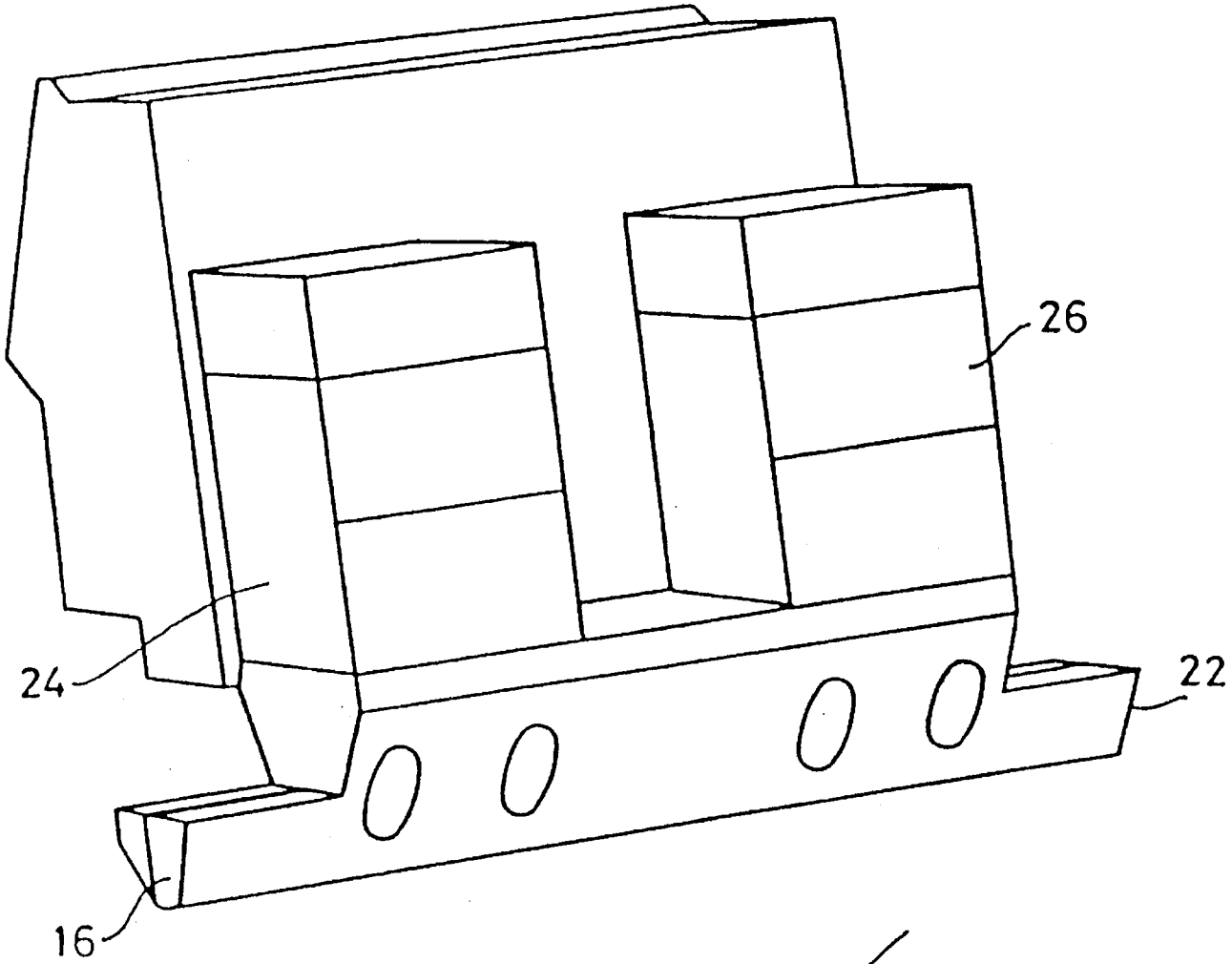
FIG. 4 shows a perspective view of an applicator suitable for use of the method according to the invention.

FIG. 4 shows how the control valves 24 and 26 can be combined with the applicator nozzle 22 to form a constructional unit. The various supply and control lines are not shown in this figure.

Figure 5:
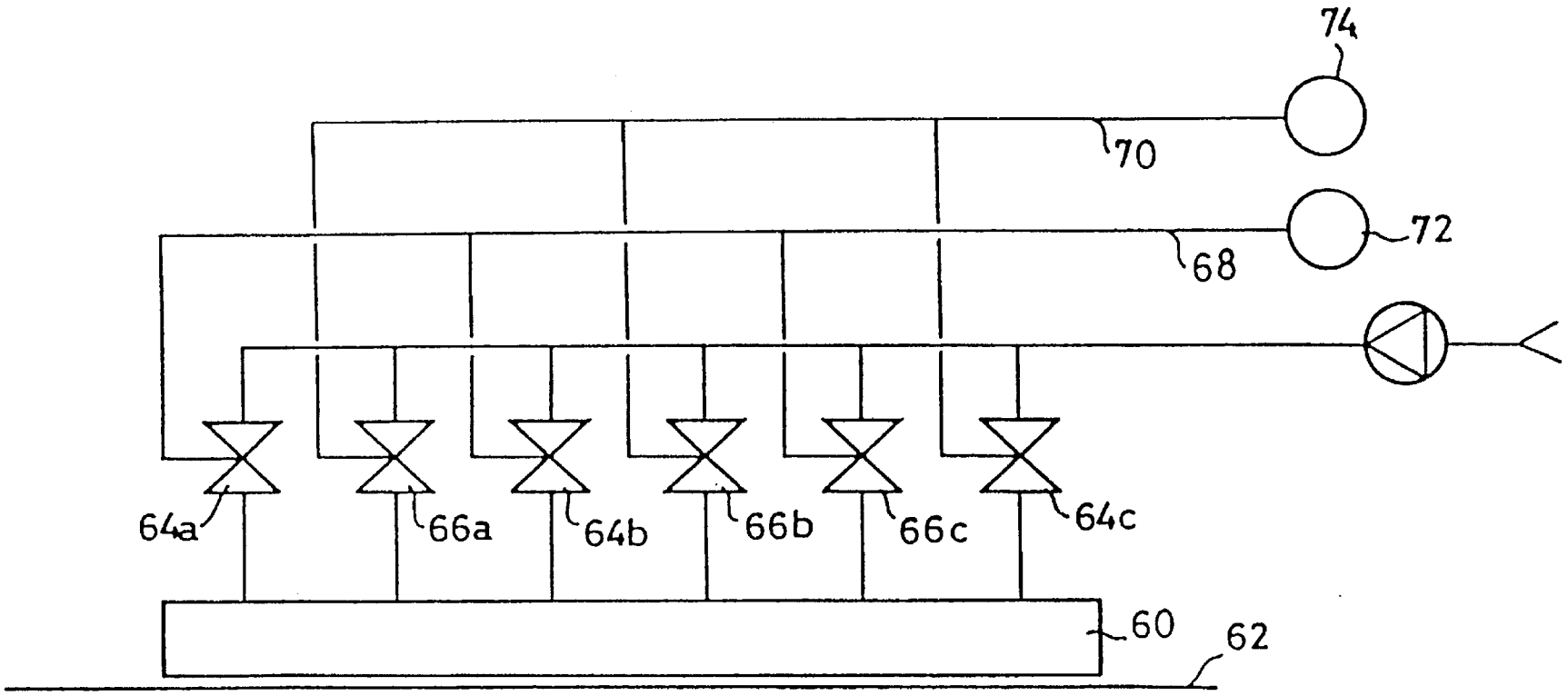
FIG. 5 shows a diagrammatic view of a plant in which the valves are sub-divided into two sets of three valves each.

Finally, FIG. 5 shows diagrammatically how, if use is made of a relatively long applicator nozzle 60 lying above the substrate 62, a uniformly distributed material supply can be achieved through the use of more than two control valves. In the case shown there are six of such control valves, sub-divided into two sets which are indicated by 64*a*, 64*b*, 64*c* and 66*a*, 66*b*, 66*c* respectively. The control valves 64*a* 64*b*, 64*c* are operated simultaneously by means of the common control line 68, and the control valves 66*a*, 66*b*, 66*c* are operated simultaneously by means of the control line 70. The control line 68 corresponds, for example, to the control line 34 in FIG. 2, and the control line 70 corresponds to the control line 42 in FIG. 2. Line 68 is connected to the shuttle valve 72, the functioning of which corresponds to that of the shuttle valve 36 in FIG. 2, while line 70 is connected to the shuttle valve 74, the functioning of which corresponds to that of the shuttle valve 44 in FIG. 2. For the sake of clarity, the remaining connections of said shuttle valves are not shown.

It is clear that in the case in which the length $l_2$, $l_3$ of the material strips is considerably smaller than the length $l_1$ of the material strips shown in FIG. 1*a* the time duration ΔT1 of the respective control pulses will be correspondingly shorter, but even then it remains long enough to ensure good functioning.

I claim:

1. Method for applying a material pattern by means of a sequentially operating applicator to a substrate moving in a direction of movement relative to said applicator, by way of a control valve means for liquid hot melt adhesive material, said valve means being controllable for opening and closing, and being connected to a material supply, which material pattern in the direction of movement of the substrate, is sub-divided into pattern parts with spacing between them, characterised in that use is made of at least two alternately operating control valves which are connected to the material supply and are made to open and close sequentially with each valve alternately being in the open position when the other valve is in the closed position and the outflow from each two alternately operating control valves being directed to locations on the substrate in a single row of pattern parts in alignment with the direction of travel of the substrate.

2. Method according to claim 1, characterised in that pneumatically controlled control valves are used.

3. Method according to claim 1, characterised in that at least two sets of control valves are used for each applicator, each set comprising at least two control valves, and said sets being made to open and close sequentially.

4. A device for applying a material pattern by means of a sequentially operating applicator to a substrate moving relative to said applicator characterised by an applicator which is fed by means of at least two alternately operating control valves which are controllable for opening and closing and are connected to a material supply, and by control means for making the respective valves open and close sequentially with each valve alternately being in the open position when the other valve is in the closed position and the outflow from each two alternately operating control valves being directed to locations on the substrate in a single row of pattern parts in alignment with the direction of travel of the substrate.

5. Device according to claim 4, characterised in that the control valves are connected to one common outflow duct.

6. Device according to claim 4, characterised in that the control valves are pneumatically operated valves.

7. Device according to claim 4, characterised in that the applicator interacts with at least two sets of control valves, of which each set comprises at least two valves, and in that the control means is designed for sequential opening and closing of the respective valves of the respective sets.

8. Device according to claim 4 wherein each of the control valves provides material for a first series of spaced apart material pattern parts and the other valve provides material for a second series of spaced apart material pattern parts, each of which lies in alternating relationship with the first series of pattern parts.

9. An applicator for applying a pattern of liquid material to a substrate during relative movement between the applicator and the substrate, said pattern sub-divided into spaced apart pattern parts, the applicator comprising:

a liquid material supply line having an intake end connected to a material supply source and an outlet end for dispensing the liquid material;

at least two alternately operating control valves connected to the supply line for controlling the flow of liquid material from the outlet end of the material supply line; and control means for causing the control valves to open and close sequentially with each valve alternately being in the open position when the other valve is in the closed position at such timed intervals that will cause the material to be dispensed in a spaced apart pattern on the substrate, the outflow from each two alternately operating control valves being directed to locations on the substrate in a single row of pattern parts in alignment with the direction of travel of the substrate.

10. An apparatus as claimed in claim 9 wherein the control valves are connected to one common outflow duct.

11. An apparatus as claimed in claim 9 wherein the control valves are pneumatically operated valves.

12. An apparatus as claimed in claim 11 wherein the control valves are pneumatically controlled by pneumatic shuttle valves which in turn are controlled electrically.

13. An apparatus as claimed in claim 9 wherein the applicator interacts with at least two sets of control valves, of which each set comprises at least two valves, and in that the control means is designed to sequential opening and closing of the respective valves of the respective sets.

* * * * *